United States Patent [19]

Danzik

[11] Patent Number: 4,634,519

[45] Date of Patent: Jan. 6, 1987

[54] PROCESS FOR REMOVING NAPHTHENIC ACIDS FROM PETROLEUM DISTILLATES

[75] Inventor: Mitchell Danzik, Pinole, Calif.

[73] Assignee: Chevron Research Company, San Francisco, Calif.

[21] Appl. No.: 743,342

[22] Filed: Jun. 11, 1985

[51] Int. Cl.[4] ..... B01J 19/02; B01J 21/16

[52] U.S. Cl. ..... 208/263; 208/289

[58] Field of Search ..... 208/263

[56] References Cited

U.S. PATENT DOCUMENTS

| | | | |
|---|---|---|---|
| 2,666,796 | 1/1954 | Gorin et al. | 208/263 |
| 2,769,767 | 11/1956 | Fierce et al. | 208/263 |
| 2,769,768 | 11/1956 | Fierce et al. | 208/263 |
| 2,808,431 | 10/1957 | Fierce et al. | 208/263 |
| 2,846,359 | 8/1958 | Myers | 208/263 |
| 2,850,435 | 9/1958 | Fierce et al. | 208/263 |
| 2,911,360 | 11/1959 | Myers | 208/263 |
| 3,824,183 | 7/1974 | Chun et al. | 208/263 |
| 3,846,288 | 11/1974 | Chun et al. | 208/263 |
| 4,299,691 | 11/1981 | Dougherty et al. | 208/263 |

*Primary Examiner*—P. E. Konopka

*Attorney, Agent, or Firm*—S. R. LaPaglia; T. G. DeJonghe; L. S. Squires

[57] ABSTRACT

Process for extracting naphthenic acids from petroleum distillates having ASTM acid numbers of at least 0.2. The process uses a solvent system comprising liquid alkanols, water, and ammonia in certain critical ratios, which facilitates the selective extraction of naphthenic acids and easy separation of the solvent and extract from the extracted petroleum distillates.

14 Claims, 1 Drawing Figure

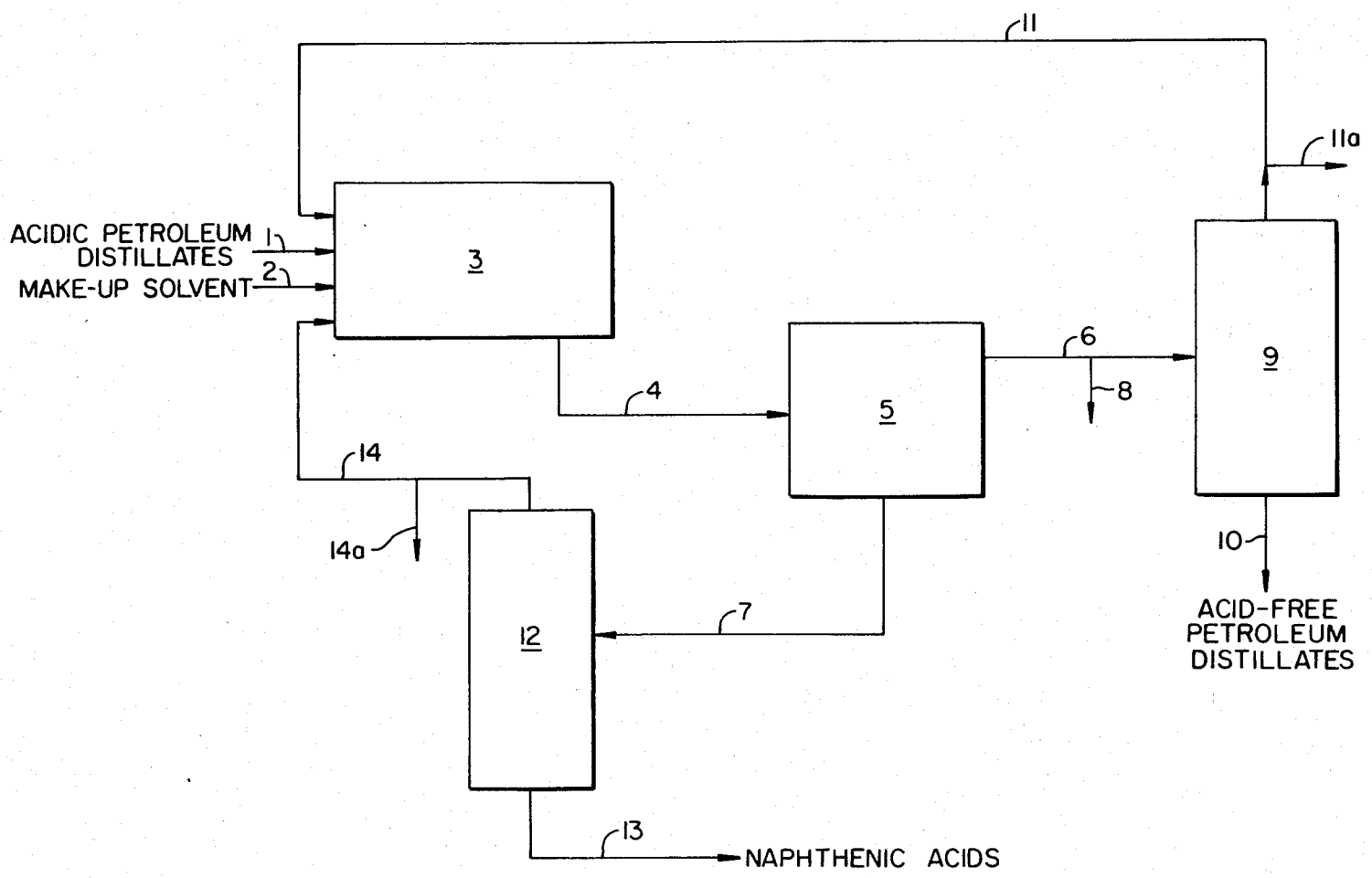
ACIDIC PETROLEUM DISTILLATES
1
MAKE-UP SOLVENT
2
3
4
5
6
7
8
9
10
ACID-FREE PETROLEUM DISTILLATES
11
11a
12
13
NAPHTHENIC ACIDS
14
14a

PROCESS FOR REMOVING NAPHTHENIC ACIDS FROM PETROLEUM DISTILLATES

BACKGROUND OF THE INVENTION

This invention relates to a process for removing naphthenic acids from petroleum distillate and the like. In a further aspect, the present process affords the recovery of relatively high purity naphthenic acids. In another aspect, the invention relates to an extraction solvent system comprising methanol, ammonium hydroxide, and water in certain critical ratios.

Crude petroleum oil and distilled fractions thereof contain appreciable amounts of naphthenic acids. These acids are useful materials, having been used to solubilize metal ions, form detergents, and the like. Furthermore, naphthenic acids are a problem in refinery operations where they cause corrosion of the metal vessels used for storage and distillation. Numerous processes have been proposed for removing naphthenic acids from hydrocarbon streams. However, to date an effective method for recovering essentially all of the naphthenic acid from a distilled hydrocarbon fraction in high purity has not been developed.

U.S. Pat. No. 2,769,768, assigned to Pure Oil Company, claims a process for extracting naphthenic acids from hydrocarbons by contacting them with a solvent comprising methanol; at least one other aliphatic, low molecular weight alcohol; and a basic agent. The preferred basic agent is ammonia.

U.S. Pat. No. 2,808,431, assigned to Pure Oil Company, teaches a process to remove high molecular weight naphthenic acids from hydrocarbons by contacting them with a two-phase mixture of a volatile, nonpolar organic liquid and a polar liquid. Typical nonpolar materials are low molecular weight aliphatic hydrocarbons; typical polar materials are volatile, low molecular weight alcohols containing minor amounts of ammonia and water. By minor amounts are meant less than 11 percent by volume of water and between 0.5–5 percent by volume base as ammonium hydroxide.

U.S. Pat. No. 2,850,435, assigned to Pure Oil Company, describes a process and a new solvent combination for the extraction of high molecular weight naphthenic acids from hydrocarbons. The solvent system of this patent is an anhydrous methanol containing 1–15 percent ammonia. Data is presented to show that the inclusion of water causes a decrease in the efficiency of the extraction. However, the highest water concentration examined was only 12 percent.

U.S. Pat. No. 2,911,360, assigned to Sun Oil Company, discloses a process for removing naphthenic acids from petroleum crudes or reduced crudes which comprises contacting the crude with 30–50 percent aqueous alcohol in the presence of a basic material (e.g., alkali metal hydroxides, ammonia, and organic amines), followed by vapor phase treatment.

SUMMARY OF THE INVENTION

I have discovered that a mixture of methanol and water and ammonia in certain critical ratios is an excellent solvent for naphthenic acids and at the same time has very little affinity for petroleum distillates. This critical mixture provides the means for obtaining high efficiency (recovery of naphthenic acids) along with high selectivity (purity of the recovered naphthenic acids) extraction of naphthenic acid-containing petroleum distillates.

The present invention provides a process for recovering naphthenic acids from distilled petroleum hydrocarbons having acid numbers greater than about 0.2, which process comprises contacting such hydrocarbons with the aforementioned solvent system, whereby the naphthenic acids are selectively dissolved into the solvent system without any significant, if any, dissolution of the petroleum hydrocarbons. It should also be noted that this process is selective in nature in that it can be advantageously applied to petroleum distillates, but cannot be successfully applied to crude oils in general.

The invention is further described hereinbelow.

THE DRAWING

A further understanding of the invention can be had from the drawing wherein the single FIGURE is a non-limiting schematic flow sheet illustrating an embodiment of the process of the invention.

FURTHER DESCRIPTION OF THE INVENTION

The present invention provides a high efficiency process for removing naphthenic acids from naphthenic acid containing distilled petroleum hydrocarbons having acid numbers greater than about 0.2. Generally, the petroleum distillates have acid numbers less than about 10. These distillates can be any of the fractions boiling within the range of about 180°–600° C. Such fractions include, for example, diesel fuel boiling in the range of about 200°–370° C.; gas oil boiling in the range of about 350°–600° C.; and jet fuel boiling in the range of about 180°–370° C. The process is especially efficacious in removing naphthenic acid from hydrocarbons petroleum distillate having acid numbers of about from 0.5 through 5.

The key to the success of the present process is its solvent system. The solvent system contains methanol, water, and ammonia in certain critical ratios. The volume ratio of methanol to water must be in the range of from 0.25 to 4 parts by volume, preferably about from 0.4 to 2.5 parts by volume of methanol per part by volume of water. Best results are generally obtained using about 0.7 parts by volume of methanol per part by volume of water. The corresponding weight ratios are about from 0.2 to 3 parts by weight of methanol per part by weight of water, preferably about from 0.3 to 2 parts by weight of methanol per part by weight of water, and most preferably about 0.6 parts by weight of methanol per part by weight of water.

The methanol-water mixture can be easily prepared by simply mixing the two components in the prescribed ratios.

In addition to water and methanol, the solvent system must contain an amount of ammonia equal to about 0.1 to 1, preferably about 0.25–0.3 parts by weight of ammonia per 100 parts by weight of petroleum distillate. This ratio is critical because if the solvent provides more or less ammonia relative to the petroleum distillate, the solvent loses its selectivity. Typically, the solvent contains about from 2 to 20 wt. % ammonia, preferably 2 to 10 wt. % ammonia. The solvent is preferably prepared by adding gaseous ammonia to the already formed water:methanol solution, but can also be prepared by adding aqueous ammonium hydroxide, with proper allowance for the quantity of water and ammonia contained therein, to methanol or aqueous methanol.

Extraction of the naphthenic acid containing hydrocarbon can be effected by contacting the hydrocarbon with the above-described solvent system. The extraction process can be conducted as a batch, semi-batch, or continuous system. Where a semi-continuous or continuous system is used, the process can be conducted either as co-current or countercurrent extraction. Preferably, the system should be conducted to maximize intimate contacts between the hydrocarbon and solvent system. Suitable mixing devices which can be used include, for example, mixing tanks, baffle mixers, mixing valves, and the like.

Typically, the extraction is conducted using a volume ratio of solvent to petroleum distillate in the range of about from 0.01 to 1 part by volume of solvent per part by volume of petroleum distillate. Preferably, a volume ratio of about from 0.025 to 0.1 parts by volume of solvent is used per part by volume of petroleum distillate. Typically, the extraction is conducted at temperatures in the range of 0°–100° C., preferably 20° to 60° C., and is conveniently conducted at ambient temperature. Higher temperatures generally aid extraction somewhat, however, as the extraction is conducted in the liquid phase, temperatures and pressures should be adjusted to maintain the liquid phase. Preferably, short contact times in the range of about from 5 seconds to 5 minutes are used. Optimum contact times will vary with the efficiency of the particular mixing device used and can be determined by routine procedures.

The present solvent and petroleum distillate are immiscible and, accordingly, can be conveniently separated from each other by allowing the petroleum distillate and solvent mixture to settle into two phases and then separating the two phases by any suitable procedure. The recovered petroleum distillate phase is now essentially free of naphthenic acids and can, depending on its intended final use, be subjected to other processing operations. The extracted petroleum distillate may contain a small amount of methanol, typically less than about 0.2 wt. % of methanol. If desired, the methanol can be removed by water washing or distillation.

The solvent phase containing the extracted naphthenic acids, as well as water, methanol, and ammonia, can be subjected to evaporation or distillation, or other suitable procedure, to recover the naphthenic acids. The naphthenic acids have higher boiling points than the other components of the solvent system. Thus, if distillation or evaporation is used, the naphthenic acids are recovered as the bottoms distillation product. The extracted naphthenic acids afforded by the present invention have good purity (i.e., generally in the order of 80–90 wt. %) and contain a minimum amount of residual oil and, thus, may be used directly to form naphthenic acid products, such as metal salts. If even higher purity naphthenic acids are desired, further purification can be accomplished by vacuum distillation.

Referring to the drawing, this is a flow sheet illustrating a continuous process embodiment of the invention. The petroleum distillates feedstock, containing naphthenic acids, is fed via line 1 to extraction mixing device 3, for example, a mixing tank or an in-line baffle mixer.

Make-up solvent is supplied to mixing device 3 via line 2. In addition, recycle methanol can be supplied to mixing device 3 via line 11 and recycle solvent supplied via line 14. (The relative quantities of recycle methanol, recycle solvent, and fresh solvent are adjusted to provide the relative ratios prescribed hereinabove.)

The mixed solvent and petroleum are fed from the mixing device 3 via line 4 to a phase separation vessel 5, for example, a settling tank. The upper, petroleum distillates, phase, which is now essentially acid-free, is fed via line 6 to optional separator 9, for example, a distillation column or a water scrubber, in which the methanol can be removed by distillation or washing with water or if the methanol impurity is not objectionable, the extracted petroleum distillates can be discharged via line 8 for further refinery operations, etc. Where the optional separator 9 is used, the essentially acid-free and methanol-free petroleum distillates are discharged from separator 9 via line 10 for use as is or can be subjected to further refinery operations. The methanol (or aqueous methanol scrubber product) from separator 9 is recycled back to mixing device 3 via line 11 or can be discharged from the system via line **11*a***.

The naphthenic acid-enriched solvent is discharged from separator 5 via line 7 and fed to separator 12, for example, an evaporator. The naphthenic acid bottoms product is discharged via line 13 and is sufficiently pure to be used directly to form various naphthenic acid products. The solvent (methanol, water, and ammonia) top product is discharged via line 14 and, preferably, recycled back to mixing device 3 or may be discharged from the system via line **14*a*. Sufficient make-up methanol, water, and ammonia is supplied via line 2** to give the total ratios required by the present invention, as set forth hereinabove.

Definitions

As used herein, the following terms have the following meanings.

The molecular weight of the naphthenic acids referred to herein is determined by mass spectra.

"Petroleum distillate acid numbers" are determined by ASTM procedure D940-80, but using phenolphthalein as the indicator.

"Boiling points" refer to boiling points at atmospheric pressure, i.e., 760 mm Hg.

A further understanding of the invention can be had from the following examples.

EXAMPLES

EXAMPLE 1

This example illustrates the application of the present invention as batch processes for the extraction of naphthenic acids from diesel oil.

In this example, a 4-liter separatory funnel was charged with 2000 g (2222 ml) of a diesel oil fraction having a boiling range of 230°–370° C. and an acid number of 2.3. To this was added a premixed solution of 67 ml (53 g) of methanol, 35 ml (35 g) of water, and 30 ml (26 g) of concentrated ammonium hydroxide containing 7.3 g of $NH_3$. This extractant solution had a methanol:water volume ratio of 1.2:1 or a weight ratio of about 1:1. The resulting mixture was shaken intermittently over a period of five minutes at room temperature. It was then allowed to stand for 16 hours at room temperature. The aqueous solvent phase and hydrocarbon phases were withdrawn separately from the separatory funnel. The upper hydrocarbon phase had an acid number of 0.23, indicating a 90-percent removal of naphthenic acids from the hydrocarbon feedstock.

The aqueous solvent phase (methanol, water, ammonia, and extracted naphthenic acids) was charged to a flask and evaporated at 70°–80° C. at an absolute pressure of 15–20 mm of mercury for about two hours, affording crude naphthenic acid residue having an acid number of 205, an average molecular weight of 255 (determined by mass spectra), and a naphthenic acid product purity, based on molecular weight, of 93 wt. %.

Three additional batch extractions were conducted generally following the above procedures but using the quantities of materials indicated in Table I hereinbelow. The results of these experiments are given in Table I.

TABLE I

Volume Ratio Diesel Oil:Extractant = 20:1

| Run No. | Diesel Oil Feed, ml | Extractant, ml | Extractant, g Methanol | Water | Ammonia |
|---|---|---|---|---|---|
| 2 | 400 (360 g) | 20 | 6.32 | 10.58 | 1.00 |
| 3 | 400 (360 g) | 20 | 3.79 | 13.78 | 1.00 |
| 4 | 400 (360 g) | 20 | 8.85 | 7.38 | 1.00 |

| Run No. | Volume Ratio Methanol: Water | Weight Ratio Methanol: Water | Weight Ratio Ammonia: Diesel Oil | Crude Naphthenic Acid Recovered % | Purity % |
|---|---|---|---|---|---|
| 2 | 0.75:1 | 0.6:1 | 0.28:100 | 93.9 | 87.7 |
| 3 | 0.34:1 | 0.28:1 | 0.28:100 | 90.3 | 78.7 |
| 4 | 1.5:1 | 1.2:1 | 0.28:100 | 94.7 | 84.3 |

EXAMPLE 1A

In Example 1, a diesel oil cut from crude oil was used. In this example, the crude oil itself was used. The example was conducted in substantially the same manner as Example 1, but using crude oil. However, it was found that after mixing and shaking the crude oil with the water-methanol-ammonia solvent, an emulsion was formed which would not separate into phases. Thus, rendering separation of the solvent extract very difficult, if even possible.

Obviously, many modifications and variations of the invention described hereinabove and below in the claims can be made without departing from the essence and scope thereof.

What is claimed is:

1. A liquid extraction process for removing naphthenic acids from naphthenic acid containing petroleum distillates boiling within the range of about 180°–600° C. and having an acid number of at least about 0.2 which process comprises the steps of:

(a) intimately contacting said petroleum distillates with a solvent consisting essentially of methanol, water, and about from 2–20 wt. % ammonia and having a methanol:water ratio in the range of about from 0.2 to 3 parts by weight of methanol per part by weight of water and using an ammonia to petroleum distillate ratio of about 0.1–1 part by weight of ammonia per 100 parts by weight of said petroleum distillate, thereby selectively extracting said naphthenic acids into said solvent and yielding an immiscible two-phase liquid mixture, one of which is a naphthenic acid-rich solvent phase and the other of which is a substantially naphthenic acid-free petroleum distillate phase; and (b) separating and respectively recovering said naphthenic acid-rich solvent phase and petroleum distillate phase.

2. The process of claim 1 wherein said solvent contains about 2–10 percent by weight ammonia.

3. The process of claim 1 wherein said solvent contains about 0.3–2 parts by weight of methanol per part by weight of water.

4. The process of claim 1 wherein the ratio of solvent ammonia to said petroleum distillate is in the range of about from 0.25–0.3 parts by weight of ammonia per part of weight of petroleum distillate.

5. The process of claim 1 wherein said step (a) is conducted at temperatures in the range of about 0° to 100° C.

6. The process of claim 1 wherein said step (a) is conducted at temperatures in the range of about 20°–60° C.

7. The process of claim 5 wherein said petroleum distillate has an acid number in the range of about from 0.5–5.

8. The process of claim 1 wherein the ratio of solvent to petroleum distillates is in the range of about from 0.1 to 1 part by volume of solvent per part by volume of petroleum distillate.

9. The process of claim 1 wherein the ratio of solvent to petroleum distillates is in the range of about from 0.026 to 0.1 part by volume of solvent per part by volume of petroleum distillate.

10. The process of claim 1 wherein said process is conducted as a continuous process.

11. The process of claim 1 wherein said process is conducted as a batch process.

12. A liquid extraction process for removing naphthenic acids from naphthenic acid containing petroleum distillates having an acid number of at least about 0.2 which process comprises the steps of:

(a) intimately contacting said petroleum distillates with a solvent consisting essentially of methanol, water, and about from 2–20 wt. % ammonia and having a ratio of methanol to water in the range of about from 0.3 to 2 parts by weight of methanol per part by weight of water using a solvent to petroleum distillates ratio in the range of about 0.025–0.1 volumes of solvent per volume of distillate and a solvent ammonia to petroleum distillate ratio of about 0.25–0.3 parts by weight of ammonia per part by weight of petroleum distillates, thereby selectively extracting said naphthenic acids into said solvent yielding a mixture comprising a naphthenic acid-rich solvent phase and a substantially naphthenic acid-free petroleum distillate phase;

(b) allowing said solvent phase and said petroleum distillate phase to settle into two distinct immiscible liquid-liquid phases and separating said phases; and (c) evaporating the separated solvent phase to remove solvent leaving a substantially pure naphthenic acid concentrate.

13. The process of claim 12 wherein said step (a) is conducted at temperatures in the range of about from 0 to 100° C.

14. The process of claim 12 wherein step (a) is conducted at temperatures in the range of about from 20°–65° C.

* * * * *